US007947887B2

(12) United States Patent
Yaguchi

(10) Patent No.: US 7,947,887 B2
(45) Date of Patent: May 24, 2011

(54) TOUCH CONTROL APPARATUS OF ELECTRONIC MUSICAL INSTRUMENT

(75) Inventor: Nariyasu Yaguchi, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 156 days.

(21) Appl. No.: 12/397,290

(22) Filed: Mar. 3, 2009

(65) Prior Publication Data

US 2009/0235810 A1 Sep. 24, 2009

(30) Foreign Application Priority Data

Mar. 21, 2008 (JP) ..... 2008-073028

(51) Int. Cl.
*G10C 3/12* (2006.01)

(52) U.S. Cl. ..... 84/439; 84/18; 84/20; 84/423 R; 84/744

(58) Field of Classification Search ..... None
See application file for complete search history.

(56) References Cited

U.S. PATENT DOCUMENTS

| | | | | |
|---|---|---|---|---|
| 5,922,983 | A | 7/1999 | Muramatsu | |
| 7,777,115 | B2 * | 8/2010 | Komatsu et al. | 84/423 R |
| 2005/0139060 | A1 | 6/2005 | Muramatsu | |
| 2005/0211050 | A1 * | 9/2005 | Fujiwara | 84/23 |
| 2008/0141847 | A1 * | 6/2008 | Komatsu et al. | 84/440 |

FOREIGN PATENT DOCUMENTS

| | | |
|---|---|---|
| JP | 2004-094160 | 3/2004 |
| JP | 2005-195619 | 7/2005 |
| JP | 2006-023287 | 1/2006 |
| JP | 3772491 | 2/2006 |

* cited by examiner

*Primary Examiner* — Marlon T Fletcher
(74) *Attorney, Agent, or Firm* — Morrison & Foerster LLP

(57) ABSTRACT

In order to detect a state of a key 30, a differential acceleration sensor 38 is provided in addition to a common position sensor 35 and a velocity sensor 36. A reaction force applied by a solenoid unit 20 is determined on the basis of a function which monotonously increases with respect to a differential acceleration signal j in an initial period which is an early stage of depression of a key. After a lapse of the initial period, the reaction force is determined in accordance with velocity, acceleration and the like, referring to a table. As a result, the reaction force rises up rapidly when a key is depressed strongly.

7 Claims, 7 Drawing Sheets

TOUCH CONTROL APPARATUS OF ELECTRONIC MUSICAL INSTRUMENT

BACKGROUND OF THE INVENTION

1. Field of the Invention

The present invention relates to a touch control apparatus of an electronic musical instrument such as an electronic piano, the touch control apparatus enabling performance operators such as keys to provide satisfactory sense of touch for a player of the electronic musical instrument.

2. Description of the Related Art

On an acoustic piano, an action mechanism in which a hammer strikes strings is driven by a manipulation of a key, results in distinctive "sense of touch" being imparted to the key for a player. An electronic piano which generates musical tone signals by an electronic tone generator is also desired to reproduce sense of touch similar to that of the acoustic piano. As an art for reproducing the sense of touch, there have been two types of arts: an art for proving an action mechanism which imitates that of the acoustic piano, and an art for reproducing the sense of touch of the acoustic piano by electrically urging a key by an actuator. As for an electronic piano of the latter type, an art for controlling the actuator is referred to as "touch control (force-perception control)".

For the touch control, the actuator for exerting a reaction force on a key is provided to increase or decrease the magnitude of the reaction force according to a current value supplied through the actuator. Because it is necessary to control the reaction force according to physical quantity relating to the operational state of the key such as the depth of depression of the key, the velocity of depression of the key or the acceleration, an electronic piano in which the touch control is performed is provided with sensors for sensing the operational state of keys. For instance, Japanese Patent Publication No. 3772491 discloses an art for obtaining position information (depth of depression of a key) by a position sensor to differentiate the position information to obtain velocity and acceleration to control reaction force on the basis of these physical quantities. In addition, Japanese Patent Publication No. 3772491 notes that differential acceleration may be used in addition to these physical quantities. However, Japanese Patent Publication No. 3772491 does not indicate any concrete scheme to utilize differential acceleration in the touch control.

Furthermore, Japanese Unexamined Patent Publication No. 2005-195619 discloses an art for directly obtaining position information and velocity information by use of a light reflective key sensor.

Furthermore, Japanese Unexamined Patent Publication No. 2006-23287 discloses an art for measuring differential acceleration of an object by use of a piezoelectric element. More specifically, the application of acceleration to an object causes deformation of a piezoelectric element provided for the object, resulting in an electric charge Q proportional to the acceleration being generated on the piezoelectric element. If the both ends of the piezoelectric element are short-circuited, a short-circuit current i which is "i=dQ/dt" passes. The short-circuit current i is proportional to differential acceleration. Therefore, the differential acceleration can be obtained by measuring the short-circuit current i.

In addition, Japanese Unexamined Patent Publication No. 2004-94160 discloses an art for laying out various kinds of electric parts (an LED and its illumination circuit) on keys without impairing the appearance of the keys.

SUMMARY OF THE INVENTION

Problems to Be Solved by the Invention

According to the art disclosed in Japanese Patent Publication No. 3772491, however, unless variation in the position information of a key (depth of depression of the key) is detected, any reaction force will not be exerted. Right after the start of depression of a key, especially on a strong depression of a key, as a result, the rising up of a reaction force with respect to the depth of depression of the key is delayed. Moreover, the keys are manipulated by a player with his fingers which are one of the most sensitive human sensory organs. Therefore, there is a problem that the delay in the rising up of reaction force makes the player recognize the sense of touch immediately after the start of depression of a key as being awkward. In order to solve the problem, a scheme in which a current is supplied through the actuators of the keys even on their rest position as well to previously apply a reaction force to the keys can be employed. However, this scheme is disadvantageous because it requires enormous amounts of power consumption.

The present invention was accomplished to solve the above-described problems, and an object thereof is to provide a touch control apparatus of an electronic musical instrument, the touch control apparatus realizing rapid rising up of reaction force to provide natural sense of touch for a player.

Means for Solving the Problems

In order to solve the above-described problems, it is a feature of the present invention to provide a touch control apparatus of an electronic musical instrument, the touch control apparatus including following constituents. Numbers and characters in parentheses are examples.

The touch control apparatus of an electronic musical instrument includes a performance operator (30) which is provided on the electronic musical instrument, supported such that the performance operator (30) pivots about a fulcrum (34), and manipulated by a player so that the performance operator (30) pivots in a certain direction; a drive means (13, 20) which is provided for the performance operator (30) and generates a reaction force urging the performance operator (30) in a direction opposite to the certain direction; a first physical quantity signal output means (38) which measures a first physical quantity related to a state in which the performance operator (30) is manipulated, and outputs a first physical quantity signal (differential acceleration signal j) indicative of the first physical quantity; a second physical quantity signal output means (35, 36) which outputs a second physical quantity signal (x, v, a) indicative of a second physical quantity related to a state in which the performance operator (30) is manipulated; a first control means (SP4 through SP12) which controls the drive means (13, 20) so that the reaction force increases with increase in the first physical quantity signal (j) during an initial period from start of manipulation of the performance operator (30) until predetermined time (ts) has elapsed or until a manipulation stroke of the performance operator (30) has reached a predetermined point (xs) of the stroke; and a second control means (SP14 through SP26) which makes the drive means (13, 20) generate the reaction force in accordance with the second physical quantity signal (x, v, a) after a lapse of the initial period.

In this case, with respect to start of manipulation of the performance operator (30), the first physical quantity signal (j) rises more rapidly than the second physical quantity signal (x, v, a).

Furthermore, the first physical quantity signal (j) is a signal indicative of a differential value of acceleration of the performance operator (30); the first physical quantity signal output means (38) is a differential acceleration sensor which measures differential value of acceleration of the performance operator (30); and the second physical quantity signal (x, v, a) is a signal indicative of any one of position (x), velocity (v) and acceleration (a) of the performance operator (30).

Furthermore, the second physical quantity signal output means (35, 36) is a sensor which measures position, velocity or acceleration of the performance operator (30).

Furthermore, the second physical quantity signal output means (35, 36) includes at least a sensor which checks whether the performance operator (30) is situated in an initial position (rest position).

Furthermore, the second physical quantity signal output means (35, 36) outputs the second physical quantity signal (x, v, a) by integrating the signal (j) indicative of differential value of acceleration.

Furthermore, the second physical quantity signal output means (35, 36) outputs a physical quantity signal (x, v, a) indicative of physical quantities of at least any two of position (x), velocity (v) and acceleration (a); and the second control means (SP14 through SP26) stores a control pattern table (42*a*) defining relationship between the two physical quantities and the reaction force, and makes the drive means (13, 20) generate the reaction force in accordance with a result read out from the control pattern table (42*a*).

Furthermore, the differential acceleration sensor (38) has a piezoelectric element (384) which deforms according to acceleration of the performance operator (30); a line (142) which connects certain points of the piezoelectric element (384); and a current measurement circuit (144) which measures a current passing through the line (142).

According to the present invention, the drive means is controlled such that the reaction force increases with increase in the differential acceleration signal of the performance operator during the initial period, and that the reaction force is generated in accordance with the position, the velocity or the acceleration of the performance operator after a lapse of the initial period. As a result, the rising up of the reaction force is accelerated to provide natural sense of touch for the player.

DESCRIPTION OF THE PREFERRED EMBODIMENT

1. Hardware Configuration of an Embodiment

1.1. Configuration of Keyboard Portion 10

Figure 1:
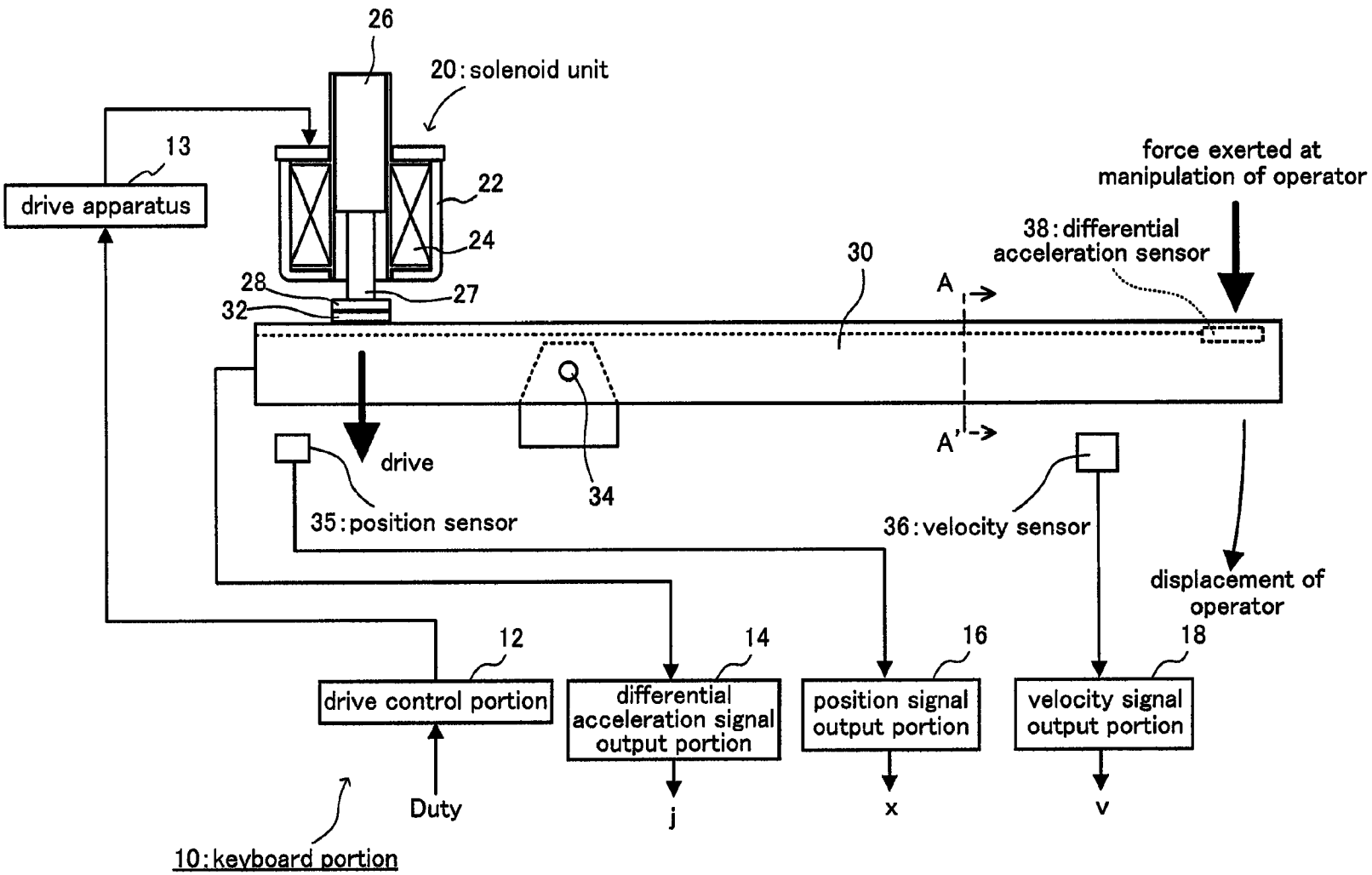
FIG. 1 is a diagram showing configuration of a keyboard portion of an electronic piano according to an embodiment of the present invention.

Next, configuration of a keyboard portion 10 of an electronic piano according to an embodiment of the present invention will now be described, referring to FIG. 1. Although the keyboard portion 10 is formed of a plurality of keys and their peripheral circuits, FIG. 1 shows the configuration of only one of the keys. A key 30 can freely pivot about a fulcrum 34. In this figure, the front of the key 30 is situated on the right side. More specifically, an end on the front side is to be depressed downward by a user. Above a rear end of the key 30, a solenoid unit 20 is provided. Inside the solenoid unit 20, a solenoid 24 is formed of a conducting wire wound to be approximately shaped like a cylinder. In addition, a yoke 22 is formed of a ferromagnet which covers the upper and lower end surfaces and the rim surface of the solenoid unit 20. The yoke 22 and the solenoid 24 form a stator of the solenoid unit 20.

A plunger 26, which is formed of a ferromagnet approximately shaped like a cylinder, is fit into a hollow part of the solenoid 24 so that the plunger 26 can be displaced upward and downward. From a bottom surface 26*b* of the plunger 26, a shaft 27 shaped like a cylinder of smaller diameter protrudes downward. The lower end of the shaft 27 is coupled to a magnetic plate 28 formed of a permanent magnet shaped like a rectangular plate. To a part of the top surface of the key 30, another rectangular magnetic plate 32 formed of a permanent magnet shaped like a rectangular plate is fixed to face the magnetic plate 28. The undersurface of the magnetic plate 28 is the S pole with the top surface of the magnetic plate 32 being the N pole, so that the magnetic plates 28, 32 attract each other.

Below the front end of the key 30, a velocity sensor 36 for sensing velocity of depression of the key 30 is provided. Below the rear end of the key 30, a position sensor 35 for sensing position of the depressed key 30 is provided. Inside the front end of the key 30, a differential acceleration sensor 38 for sensing differential value of the acceleration of the key 30 is embedded. A differential acceleration signal output portion 14 outputs a differential acceleration signal j on the basis of a signal sensed by the differential acceleration sensor 38. A position signal output portion 16 outputs a position signal x on the basis of a signal sensed by the position sensor 35. A velocity signal output portion 18 outputs a velocity signal v on the basis of a signal sensed by the velocity sensor 36.

A drive apparatus 13 supplies a current through the solenoid 24 to urge the plunger 26 downward. The current supplied from the drive apparatus 13 to the solenoid 24 is a pulse width modulated (PWM) direct current, so that the reaction force exerted on the key 30 increases or decreases in accordance with duty ratio of the pulse width modulation (PWM). A drive control portion 12 supplies a PWM signal to the drive apparatus 13 in accordance with a later-described command value Duty. As a result, a driving force is produced in a direction opposing a force produced by a user at the depression of the key. The driving force is perceived by the user with his finger as "sense of touch". As described above, FIG. 1 shows the configuration of only one of the keys. Therefore, the respective constituents shown in FIG. 1 are provided for the same number as the number of the keys 30.

1.2. Detailed Configuration of the Differential Acceleration Sensor 38

Figure 2A:
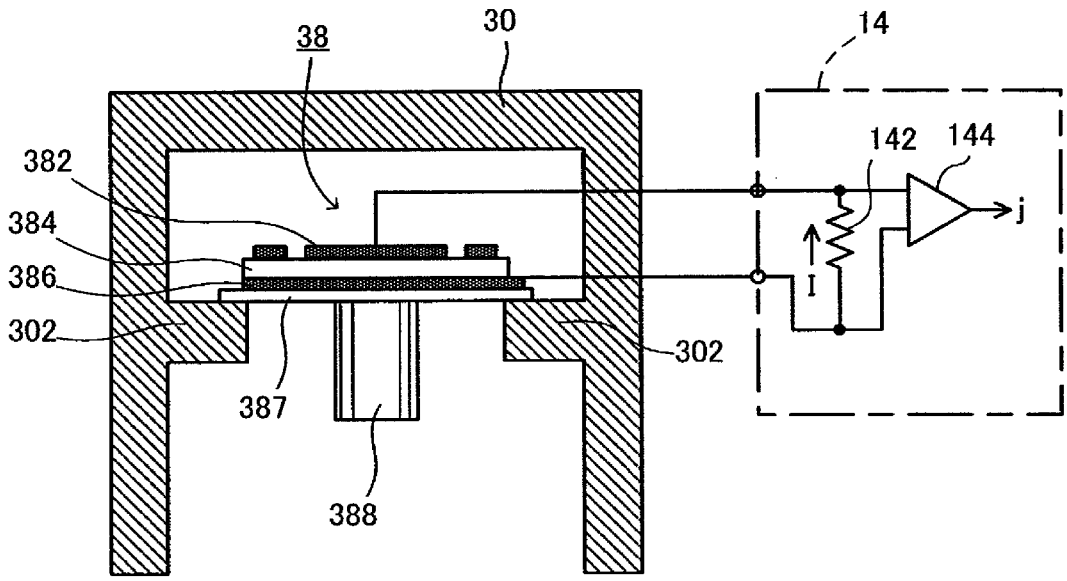
FIG. 2A shows diagrams showing detailed configuration of a differential acceleration sensor.
Figure 2B:
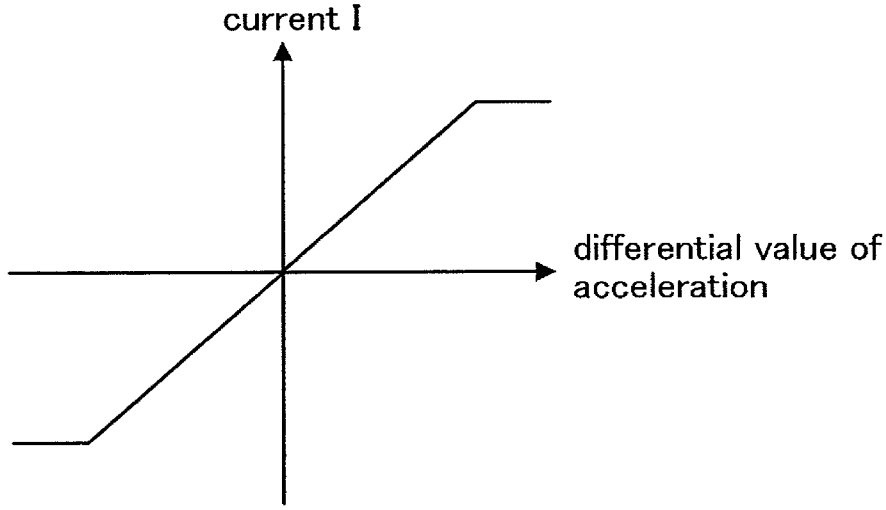
FIG. 2B shows a diagram indicative of relationship among current flowing in a differential acceleration signal output portion and differential acceleration.

Referring to FIGS. 2A and 2B, the differential acceleration sensor 38 will be described in detail. FIG. 2A is an A-A' cross sectional view of FIG. 1. From interior walls of the key 30, supporting platforms 302, 302 having a rectangular cross section protrude inwardly. To the top surface of the respective supporting platforms 302, 302, right and left ends of a diaphragm 387 shaped like a thin plate are fixed. To the undersurface of the diaphragm 387, an approximately cylindrical spindle 388 is fixed. On the top surface of the diaphragm 387, a lower electrode 386, a piezoelectric element 384 such as PZT, and an upper electrode 382 are laminated. The upper electrode 382 and the lower electrode 386 are connected to the both ends of a resistor 142 provided inside the differential acceleration signal output portion 14. An amplifier 144 amplifies voltage of terminals of the resistor 142 to output the amplified voltage.

In the above-described configuration, if the key 30 is depressed to apply downward acceleration to the key 30, the spindle 388 tries to keep the previous position by inertia, resulting in the diaphragm 387 deflecting in accordance with the acceleration as if it bulged upward. Furthermore, the piezoelectric element 384 also deflects along the diaphragm 387, resulting in an electric charge Q proportional to the acceleration being produced on the piezoelectric element 384. The electric charge Q is discharged via the resistor 142, so that a current I passes through the resistor 142. FIG. 2B shows an example relationship between the differential acceleration and the current I. As shown in FIG. 2B, if the differential acceleration of the key 30 grows, the current I varies nonlinearly, for the diaphragm 387 reaches the limit of deflection. Within an area smaller than a nonlinear area, however, the current I is proportional to the differential acceleration.

The reason why the current I is proportional to the differential acceleration is that the current I is proportional to time differentiation of the electric charge Q (dQ/dt), while the electric charge Q is proportional to the acceleration of the key 30, resulting in the current I being proportional to the differential acceleration of the key 30. Therefore, the terminal voltage of the resistor 142 is also proportional to the differential acceleration. Consequently, the amplifier 144 outputs the differential acceleration signal j which is a voltage signal proportional to the actual differential acceleration.

1.3. Configuration of Control Circuit

Figure 3:
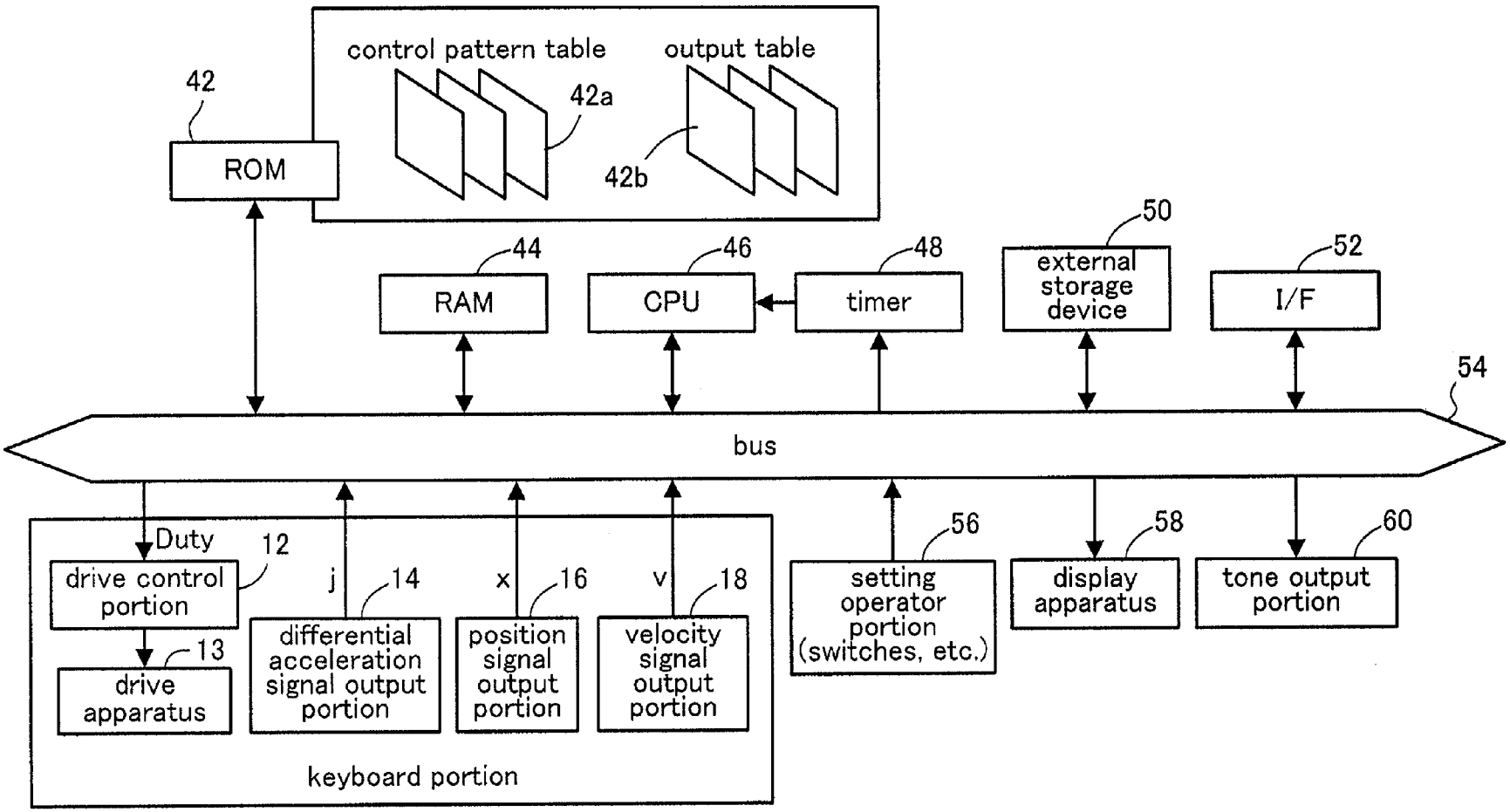
FIG. 3 is a block diagram showing a control circuit of the electronic piano according to the embodiment.

Next, the configuration of a control circuit of the electronic piano of the embodiment will be described, referring to FIG. 3. In FIG. 3, a CPU 46 controls other constituents through a bus 54 in accordance with programs stored in a ROM 42. A RAM 44 is used as a working memory for the CPU 46. An external storage device 50, which is formed of a memory card, for instance, stores performance information and the like stored in the RAM 44 as required. A communications interface 52 inputs and outputs MIDI signals and the like. A setting operator portion 56 is formed of switches and knobs for making various settings. A display apparatus 58 displays various kinds of information for a user. A tone output portion 60 synthesizes musical tone signals in accordance with performance information supplied by the CPU 46 to emit tones in accordance with the synthesized musical tone signals.

As described above, the keyboard portion 10 outputs the differential acceleration signal j, the position signal x and the velocity signal v. These signals are supplied to the CPU 46 through the bus 54. In addition, a command value Duty output by the CPU 46 is supplied to the keyboard portion 10 through the bus 54. The ROM 42 stores not only the programs executed by the CPU 46 but also various tables provided for touch control. More specifically, a control pattern table 42*a* defines driving force F which is to be produced on the solenoid unit 20 on the basis of the position signal x, the velocity signal v and an acceleration signal a. The acceleration signal a is obtained by differentiation of the velocity signal v. Although the control pattern table has been described in detail in Japanese Patent Publication No. 3772491 noted in Description of the Related Art, the control pattern table will now be explained briefly.

Figure 4:
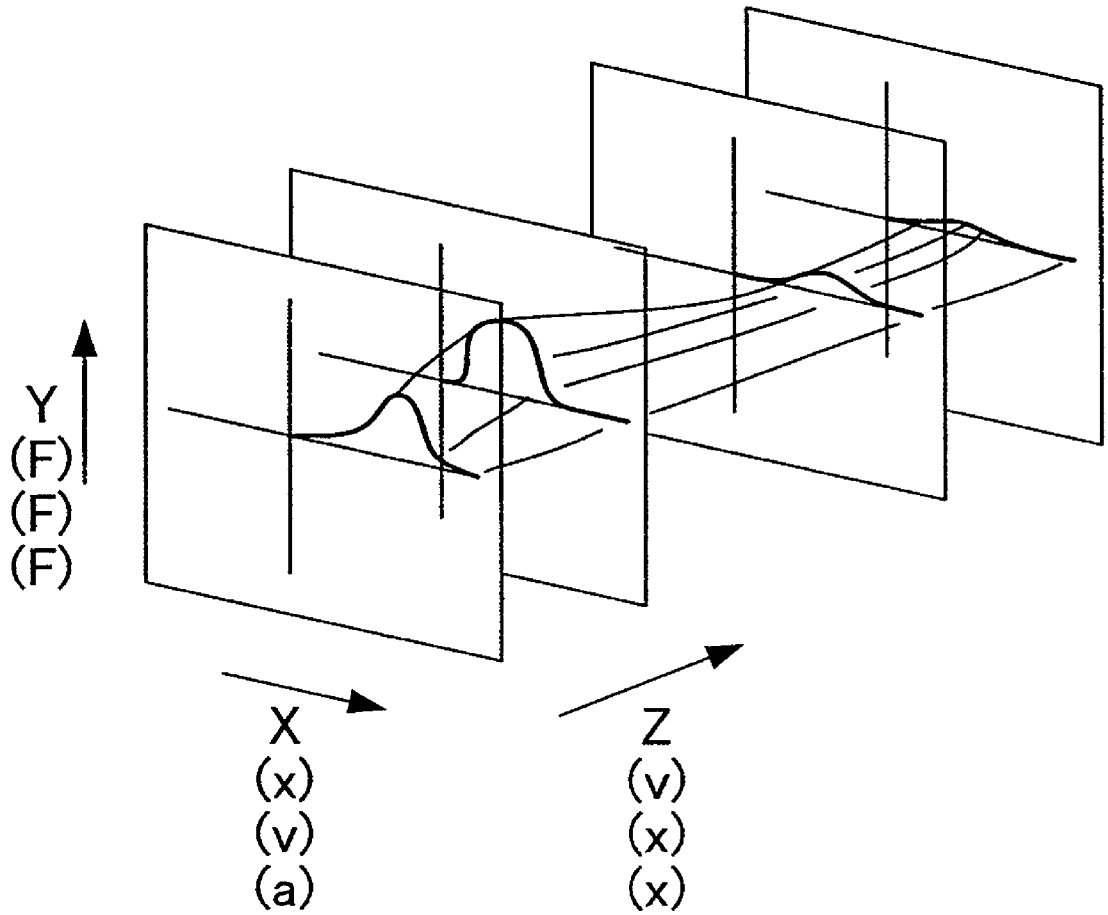
FIG. 4 is a graph showing relationship between driving force F and position signal x, velocity signal v, and acceleration signal a stored in a control pattern table.

Basically, there are three kinds of control pattern tables. The first control pattern table stores the driving force (reaction force) F in correspondence with the position signal x and the velocity signal v. In the first control pattern table, as shown in FIG. 4, a plurality of velocity signals v are adopted in the Z axis direction, so that the first control pattern table has a plurality of XY tables provided for the plurality of different velocity signals v. In each XY table, the position signal x is adopted in the X axis direction with the driving force F being adopted in the Y axis direction to store the driving force F which varies with the varying position signal x. The calculation of the driving force F involves an interpolation process. The second control pattern table is configured similarly to the first control pattern table. In the second control pattern table, however, the position signal x is adopted in the Z axis, while the velocity signal v is adopted in the X axis, with the driving force F being adopted in the Y axis. The third control pattern table is also configured similarly to the first and second control tables. In the third control pattern table, however, the position signal x is adopted in the Z axis, while the acceleration signal a is adopted in the X axis, with the driving force F being adopted in the Y axis. Although the concrete variation curves shown in FIG. 4 vary among the first to third control pattern tables, the variation curves of the first to third control pattern tables exhibit roughly similar variation tendency.

An output table 42*b*, which defines the command value Duty in accordance with the driving force F, stores the command value Duty proportional to the driving force F. This table is also described in the above-described Japanese Patent Publication No. 3772491. The description of the Japanese Patent Publication No. 3772491 is incorporated in this specification.

2. Operation of the Embodiment

Figure 5:
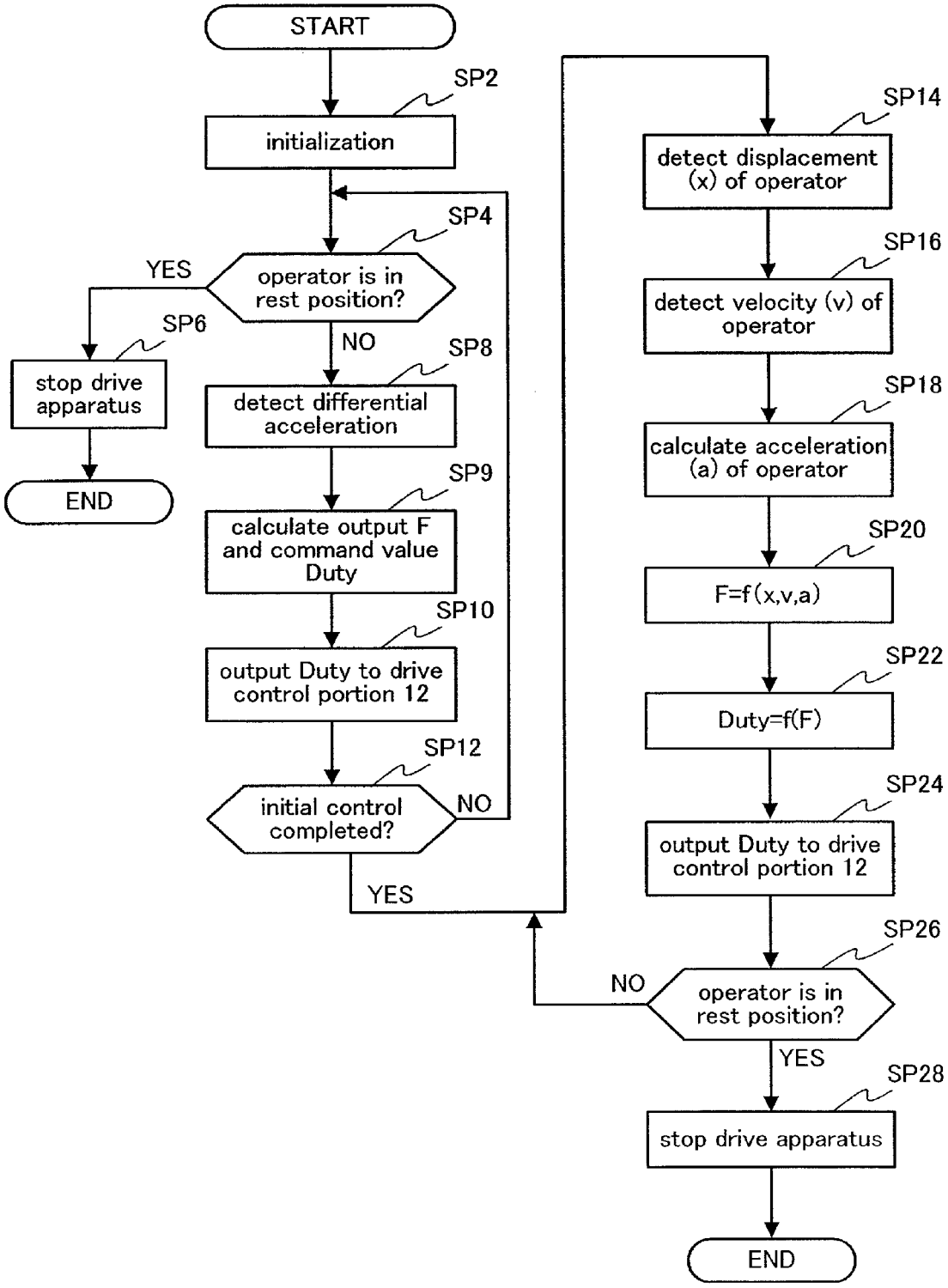
FIG. 5 is a flowchart showing a touch control program executed on the electronic piano of the embodiment.

Next, the operation of the embodiment will be described. In this embodiment, the position signals x of all of the keys 30 are monitored to continuously check whether the respective position signals x of the keys 30 are away from their rest positions, in other words, whether the depression of the respective keys 30 has been started. If the start of the depression of any of the keys 30 has been detected, a touch control program shown in FIG. 5 is started for the key. More specifically, the CPU 46 can operate in a multitasking manner. In a case where two or more of the keys 30 are depressed, therefore, the program shown in FIG. 5 is carried out for the respective two or more keys as separate processes.

In FIG. 5, when the process proceeds to step SP2, a certain initialization is carried out. The process then proceeds to step SP4 to determine whether the position signal x of the target key 30 for which the process is performed has been returned to its rest position. If a positive determination is made, the process proceeds to step SP6 to make a corresponding drive apparatus 13 stop driving of the key 30. By turning off the power of the drive apparatus 13 of the key 30 which has returned to the rest position, in addition, only the drive apparatuses 13 of actually depressed keys 30 are brought into operation. Therefore, the embodiment can further reduce power consumption.

If the key 30 has not returned to the rest position, the process makes a negative determination in step SP4 to proceed to step SP8. In step SP8, the differential acceleration signal j of the target key 30 is detected. In the next step SP9, the process calculates the driving force F to be applied to the key 30 on the basis of the differential acceleration signal j and refers to the output table 42*b* to calculate the command value Duty (duty ratio of the pulse width modulation (PWM)) required for generating the driving force F. The calculation carried out in step SP9 is applied only to the initial phase of the depression of a key. The driving force F is defined by a monotone increasing function of the differential acceleration signal j, so that the driving force F is to be set to a value which increases proportionately with increase in the differential acceleration signal j. Furthermore, the process refers to the output table 42*b* to set the command value Duty to a value which increases approximately proportionately with increase in the driving force F.

The process then proceeds to step SP10 to output the obtained command value Duty to a drive control portion 12. The output of the command value Duty makes the drive control portion 12 supply a pulse width modulation (PWM) signal having a duty ratio equal to the command value Duty to the drive apparatus 13 to supply a pulse width modulated current from the drive apparatus 13 to the solenoid 24 to apply a driving force according to the command value Duty to the key 30. The process then proceeds to step SP12 to determine whether a certain "initial control completion condition" is satisfied. It is preferable that the initial control completion condition is, for example, whether a time t lapsed from the start of depression of the key (from the start of execution of the program shown in FIG. 5) has reached a predetermined time ts. Furthermore, it is preferable that the predetermined time ts is "1 msec" or less.

If the "initial control completion condition" has not been satisfied, the process makes a negative determination in step SP12 to return to step SP4. Then, as long as the key 30 has not returned to its rest position, until the initial control completion condition is satisfied, the process repeats steps SP4 through SP12 to set the command value Duty to a value according only to the differential acceleration signal j to continue applying a reaction force, on the basis of the command value Duty, to the key 30 by the drive control portion 12, the drive apparatus 13 and the solenoid unit 20.

Then, if the initial control completion condition is satisfied, the process proceeds to step SP14 to detect the position signal x through the position signal output portion 16. The process then proceeds to step SP16 to detect the velocity signal v through the velocity signal output portion 18. The process then proceeds to step SP18 to obtain the acceleration signal a by differentiation of the velocity signal v. The process then proceeds to step SP20 to calculate the driving force F according to the respective signals x, v, a by use of the control pattern table 42*a*. The process then proceeds to step SP22 to calculate the command value Duty according to the driving force F, referring to the output table 42*b*. The process proceeds to step SP24 to output the calculated command value Duty to the drive control portion 12. By these steps, as in the case of the above-described step SP10, the driving force according to the command value Duty is applied to the key 30.

Although the calculation of the driving force F is described in detail in the above-described Japanese Patent Publication No. 3772491, the calculation will now be briefly explained. First, referring to the first control pattern table (FIG. 4), a driving force F1 varying according to the position signal x (X axis) and the velocity signal v (Z axis) is calculated. Then, referring to the second control pattern table (FIG. 4), a driving force F2 varying according to the velocity signal v (X axis) and the position signal x (Z axis) is calculated. Then, referring to the third control pattern table (FIG. 4), a driving force F3 varying according to the acceleration signal a (X axis) and the position signal x (Z axis) is calculated. In the calculation of the driving forces F1, F2, F3, although the values with respect to the X axis, Y axis and Z axis are stored in the first through third control pattern tables, the values are not continuous. Therefore, an interpolation is performed as necessary. After the calculation of the driving forces F1, F2, F3, these driving forces F1, F2, F3 are combined to obtain the driving force F in the end.

In the above description, the embodiment is designed to use the same first through third control pattern tables regardless of the direction in which the key 30 moves. However, the embodiment may be modified to have two kinds of first to third pattern tables (especially, the first control pattern table) to correspond to depression of the key 30 and release of the key 30 so that the driving forces F1, F2, F3 are obtained in a manner in which the depression and the release of the key 30 are distinguished from each other. This modification enables the electronic piano to have such characteristics of the reaction force applied at the time of user's manipulation of the key 30 as vary between the depression and the release of the key 30. In other words, this modification enables the electronic piano to exhibit hysteresis in key touch similar to that of an acoustic piano.

The process then proceeds to step SP26 to determine whether the position signal x of the key 30 has returned to the rest position. If the key 30 has not returned to the rest position, the process makes a negative determination to return to step SP14. The process then repeats steps SP14 through SP26 until the key 30 returns to the rest position to set the command value Duty to a value according to the position signal x, the velocity signal v and the acceleration signal a to continue applying a reaction force to the key 30 by the drive control portion 12, the drive apparatus 13 and the solenoid unit 20 on the basis of the command value Duty. If the key 30 has returned to the rest position, the process makes a positive determination in step SP26 to proceed to step SP28. In step SP28, the drive apparatus 13 is stopped as in the case of step SP6.

3. Effect of the Embodiment

Figure 6:
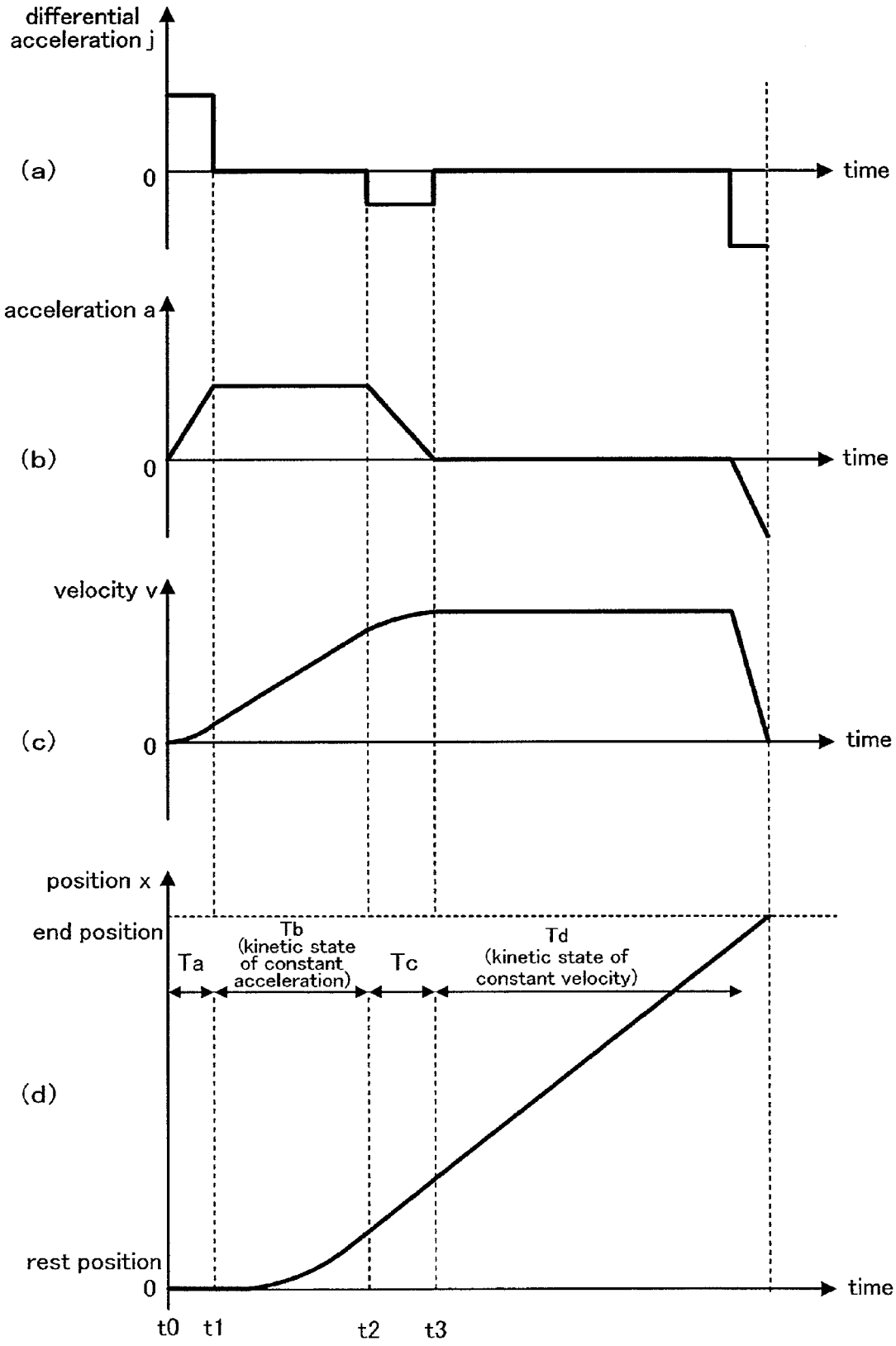
FIG. 6 shows diagrams indicative of relationship among depressed position, velocity, acceleration and differential acceleration of an acoustic piano key.

Next, an effect of the present embodiment will be described, referring to FIG. 6(*a*) through FIG. 6(*d*). FIG. 6(*a*) through FIG. 6(*d*) show representative examples of the differential acceleration, the acceleration, the velocity and the depressed position of a depressed key of an acoustic piano. In FIG. 6(*d*), after the start of depression of a key at time to, the key gradually accelerates to keep constant velocity at time t3 and later. A further detailed analysis of the sections between time t0 and time t3 revealed that, in section Ta between time t0 and time t1, the acceleration of the key 30 increases at an approximately constant rate. In section Ta, in other words, the key 30 is in a kinetic state where the positive differential value of the acceleration is almost constant.

In the next section Tb between time t1 and time t2, the key 30 is in a kinetic state of constant acceleration where the velocity increases at an approximately constant acceleration. In the next section Tc between time t2 and time t3, the key 30 is in a kinetic state where the acceleration decreases at an approximately constant rate. In section Tc, in other words, the key 30 is in a kinetic state where the differential value of the acceleration is negative and almost constant. In section Tc, that is, the key 30 enters the kinetic state of constant differential acceleration. As apparent from FIG. 6(*a*) through FIG. 6(*d*), the rising up of the differential acceleration is extremely rapid (in other words, time required from the start of the depression of a key to the peak is the shortest), compared to the other signals. By the control of reaction force on the basis of the differential acceleration, therefore, the rising up of the reaction force can be accelerated, especially in cases where a key is depressed strongly.

4. Modifications

The present invention is not limited to the above-described embodiment, and can be variously modified as described below as examples:

(1) In the above-described embodiment, the position sensor 35, the velocity sensor 36 and the differential acceleration sensor 38 measure the kinetic state of the key 30. In cases where a sufficiently precise sensor is employed as the differential acceleration sensor 38, however, the position sensor 35 and the velocity sensor 36 may be omitted. This is because the precise differential acceleration signal j enables obtainment of the acceleration signal a, the velocity signal v and the position signal x by the integral of the differential acceleration signal j. In order to turn off the drive apparatus 13 (steps SP6 and SP28), however, it is preferable to separately provide a means for checking whether the key 30 has returned to the rest position. This is because if the integrals accumulate errors to end up with erroneous position signal x, it is difficult to precisely detect the recovery of the key 30 to the rest position only by the position signal x. The checking means can be realized by a contact sensor such as a simple micro switch.

Figure 7:
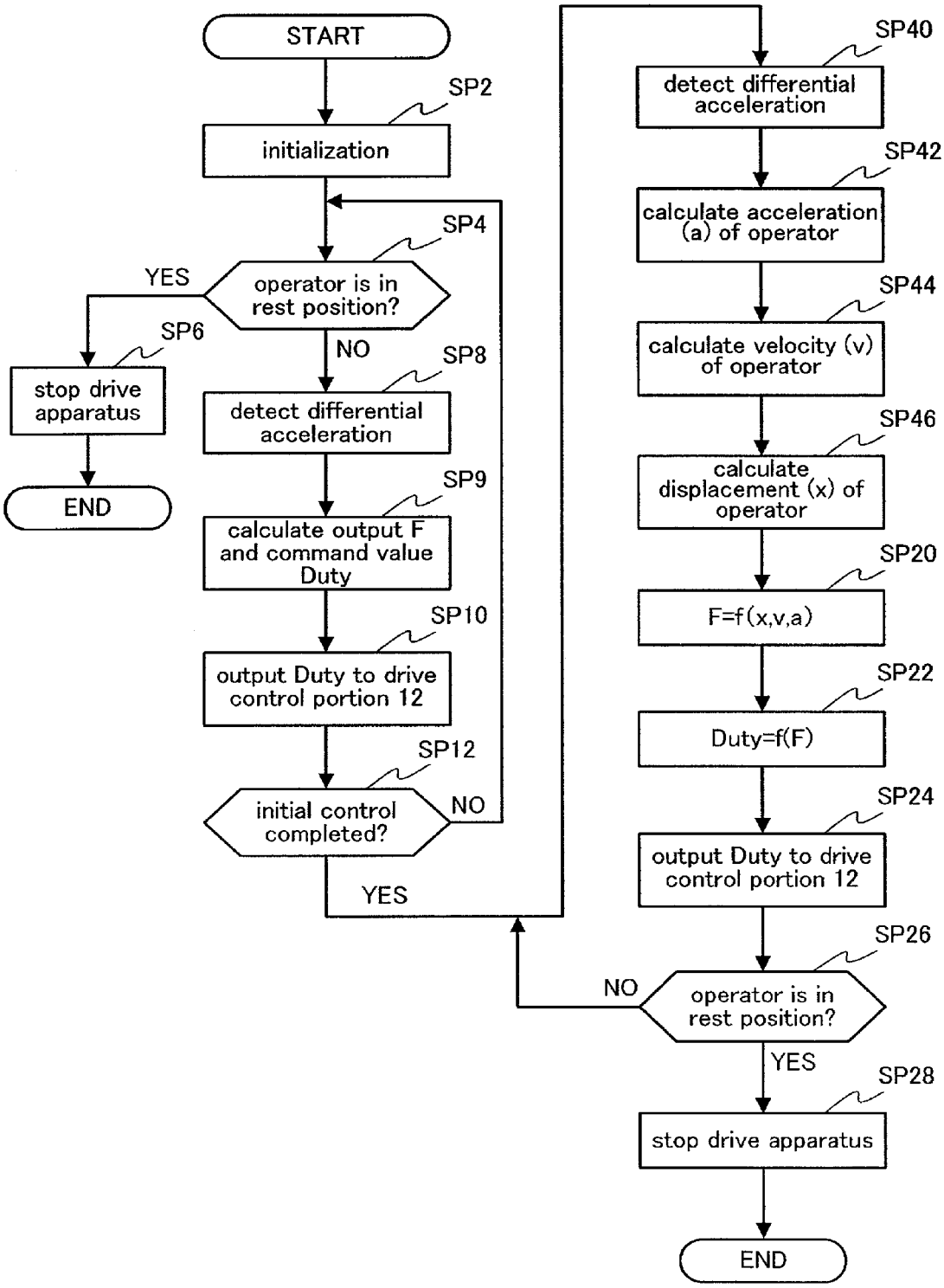
FIG. 7 is a flowchart showing a touch control program of a modification of the embodiment.

In this modification, the touch control program shown in FIG. 5 is replaced with a touch control program shown in FIG. 7. In the program shown in FIG. 7, steps SP14 through SP18 of FIG. 5 are replaced with steps SP40 through SP46. Other steps are similar to those of FIG. 5. In step SP40, the differential acceleration value j is input from the differential acceleration sensor 38. In the next step SP42, the differential acceleration value j is integrated to obtain the acceleration signal a. In the next step SP44, the acceleration signal a is integrated to obtain the velocity signal v. In the next step SP46, the velocity signal v is integrated to obtain the position signal x.

(2) In the above-described embodiment, the "initial control completion condition" determined in step SP12 is whether the predetermined time ts has lapsed since the start of depression of the key. However, the determination on the initial control completion condition may employ the position signal x. For instance, the initial control completion condition may be whether the position signal x has reached a predetermined position xs. Alternatively, both time and distance may be employed. More specifically, the initial control completion condition may be whether the predetermined time ts has elapsed since the start of depression of the key, and/or the position signal x has reached the predetermined position xs. The predetermined position xs is preferable to be one-fifth or less of the entire stroke of the position signal x. Assume that the entire stroke on the edge of the key 30 is "10 mm", for example. Then, it is preferable to define any value exceeding "0 mm" and falling within "2 mm" as the predetermined position xs.

(3) The above-described embodiment is designed such that, in step SP20, reference is made to the first through third pattern tables which form the control pattern table to calculate the three driving forces F1, F2, F3 by use of the position signal x, the velocity signal v and the acceleration signal a to combine these driving forces F1, F2, F3 to obtain the driving force F in the end. However, the embodiment may be modified such that part of the driving forces F1, F2, F3 is calculated by use of part of the position signal x, the velocity signal v and the acceleration signal a and part of the first through third control pattern tables to obtain the driving force F in the end by use of the calculated partial driving force. Alternatively, the embodiment may be modified such that by use of the whole or part of the position signal x, the velocity signal v and the acceleration signal a, the driving force F is obtained on the basis of a table which is different from the first through third control pattern tables or a certain computation. Furthermore, the command value Duty according to the driving force F may be obtained by a computation using function without using the output table 42*b* in step SP9.

(4) In the above-described embodiment, the solenoid unit 20 is provided behind the fulcrum 34 of the key 30 to be situated above the key 30 to urge the key 30 downward. However, the solenoid unit 20 may be provided in front of the fulcrum 34 to be situated below the key 30 to urge the key 30 upward.

(5) The above-described embodiment is designed to have the position sensor 35 and the velocity sensor 36 to obtain the acceleration signal a by differentiating the velocity signal v. However, the embodiment may be modified to have an acceleration sensor as well to directly obtain the acceleration signal a by the acceleration sensor. Furthermore, the position sensor 35 may be omitted. In this case, the position signal x is obtained by the integral of the velocity signal v. As described in the above-described modification (1), however, in the case where the position sensor 35 is omitted, it is preferable to separately provide the means for checking whether the key 30 has returned to the rest position.

(6) The position sensor 35, the velocity sensor 36 and the acceleration sensor may be provided either separately or integrally.

(7) In the above-described embodiment, the example in which the touch control of the key 30 is performed has been described. However, the present invention is not limited to the keys but may be applied to the touch control of an operator such as a pedal.

What is claimed is:

1. A touch control apparatus of an electronic musical instrument, the touch control apparatus comprising:

a performance operator which is provided on the electronic musical instrument, supported such that the performance operator pivots about a fulcrum, and manipulated by a player so that the performance operator pivots in a certain direction;

a drive means which is provided for the performance operator and generates a reaction force urging the performance operator in a direction opposite to the certain direction;

a first physical quantity signal output means which measures a first physical quantity related to a state in which the performance operator is manipulated, and outputs a first physical quantity signal indicative of the first physical quantity;

a second physical quantity signal output means which outputs a second physical quantity signal indicative of a second physical quantity related to a state in which the performance operator is manipulated;

a first control means which controls the drive means so that the reaction force increases with increase in the first physical quantity signal during an initial period from start of manipulation of the performance operator until predetermined time has elapsed or until a manipulation stroke of the performance operator has reached a predetermined point of the stroke; and a second control means which makes the drive means generate the reaction force in accordance with the second physical quantity signal after a lapse of the initial period, wherein the first physical quantity signal is a signal indicative of a differential value of acceleration of the performance operator, wherein the first physical quantity signal output means is a differential acceleration sensor which measures differential value of acceleration of the performance operator, and wherein the second physical quantity signal is a signal indicative of any one of position, velocity and acceleration of the performance operator.

2. A touch control apparatus of an electronic musical instrument according to claim 1, wherein with respect to start of manipulation of the performance operator, the first physical quantity signal rises more rapidly than the second physical quantity signal.

3. A touch control apparatus of an electronic musical instrument according to claim 1, wherein the second physical quantity signal output means is a sensor which measures position, velocity or acceleration of the performance operator.

4. A touch control apparatus of an electronic musical instrument according to claim 1, wherein the second physical quantity signal output means includes at least a sensor which checks whether the performance operator is situated in an initial position.

5. A touch control apparatus of an electronic musical instrument according to claim 1, wherein the second physical quantity signal output means outputs the second physical quantity signal by integrating the signal indicative of differential value of acceleration.

6. A touch control apparatus of an electronic musical instrument according to claim 1, wherein the second physical quantity signal output means outputs a physical quantity signal indicative of physical quantities of at least any two of position, velocity and acceleration; and the second control means stores a control pattern table defining relationship between the two physical quantities and the reaction force, and makes the drive means generate the reaction force in accordance with a result read out from the control pattern table.

7. A touch control apparatus of an electronic musical instrument according to claim 1, wherein the differential acceleration sensor comprises:

a piezoelectric element which deforms according to acceleration of the performance operator;

a line which connects certain points of the piezoelectric element; and a current measurement circuit which measures a current passing through the line.

* * * * *